US010775712B2

(12) United States Patent
Shimizu et al.

(10) Patent No.: US 10,775,712 B2
(45) **Date of Patent: *Sep. 15, 2020**

(54) IMAGE FORMING APPARATUS WITH A CHARGING AMOUNT ACQUISITION UNIT THAT PERFORMS A CHARGING AMOUNT ACQUISITION OPERATION FOR FORMING A MEASUREMENT TONER IMAGE ON AN IMAGE CARRIER

(71) Applicant: KYOCERA Document Solutions Inc., Osaka-shi (JP)

(72) Inventors: Tamotsu Shimizu, Osaka (JP); Yasushi Imanishi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/424,566

(22) Filed: May 29, 2019

(65) Prior Publication Data

US 2019/0369522 A1 Dec. 5, 2019

(30) Foreign Application Priority Data

May 30, 2018 (JP) ..... 2018-103218

(51) Int. Cl.
*G03G 15/06* (2006.01)

(52) U.S. Cl.
CPC ..... *G03G 15/065* (2013.01)

(58) Field of Classification Search
CPC ... G03G 15/65; G03G 15/266; G03G 15/5058
See application file for complete search history.

(56) References Cited

U.S. PATENT DOCUMENTS 5,729,787 A 3/1998 Resch, III
2003/0219266 A1 11/2003 Itagaki et al.
(Continued)

FOREIGN PATENT DOCUMENTS

JP 2003-345075 12/2003
JP 2004-37952 2/2004
(Continued)

*Primary Examiner* — Walter L Lindsay, Jr.
*Assistant Examiner* — Andrew V Do
(74) *Attorney, Agent, or Firm* — Gerald E. Hespos; Michael J. Porco; Matthew T. Hespos

(57) ABSTRACT

An image forming apparatus includes a storage unit and a charging amount acquisition unit. The charging amount acquisition unit forms a measurement toner image on the image carrier while changing the frequency of the alternating current voltage of the development bias with the potential difference in the direct current voltage between the developing roller and the image carrier being kept constant, acquires a tilt of a measurement straight line representing a relationship between the change amount of the frequency and the density change amount of the measurement toner image, based on the change amount of the frequency and a result of detecting density of the measurement toner image in the density detecting unit, and acquires a charging amount of the toner included in the measurement toner image formed on the image carrier based on the acquired tilt of the measurement straight line and the reference information in the storage unit according to the toner density detected by the toner density detecting unit.

4 Claims, 11 Drawing Sheets

(56) References Cited

U.S. PATENT DOCUMENTS

| | | | | |
|---|---|---|---|---|
| 2006/0198655 | A1 | 9/2006 | Kotera | |
| 2009/0297229 | A1 | 12/2009 | Tomizawa | |
| 2012/0327480 | A1 | 12/2012 | Yamane | |
| 2013/0028621 | A1 | 1/2013 | Furukawa | |
| 2017/0153564 | A1 | 6/2017 | Kanaya | |
| 2019/0369521 | A1* | 12/2019 | Shimizu ..... | G03G 15/5058 |
| 2019/0369537 | A1* | 12/2019 | Yamaguchi ..... | G03G 15/0266 |

FOREIGN PATENT DOCUMENTS

| | | |
|---|---|---|
| JP | 4480066 | 3/2010 |
| JP | 5024192 | 6/2012 |
| JP | 5273542 | 5/2013 |

* cited by examiner

IMAGE FORMING APPARATUS WITH A CHARGING AMOUNT ACQUISITION UNIT THAT PERFORMS A CHARGING AMOUNT ACQUISITION OPERATION FOR FORMING A MEASUREMENT TONER IMAGE ON AN IMAGE CARRIER

INCORPORATION BY REFERENCE

This application contains subject matter related to Japanese Patent Application No. 2018-103218 filed in Japanese Patent Office on May 30, 2018, the entire content of which being incorporated herein by reference.

BACKGROUND

The present disclosure relates to an image forming apparatus that forms an image on a sheet.

Conventionally, a known image forming apparatus, which forms an image on a sheet, includes a photoconductive drum (an image carrier), a developing device, and a transfer member. An electrostatic latent image formed on the photoconductive drum is developed on a development nip portion by the developing device, and thus a toner image is formed on the photoconductive drum. The transfer member transfers the toner image to a sheet. As the developing device to be applied to such an image forming apparatus, a two-component developing technique using developer including toner and carrier is known.

In the two-component development, the developer is deteriorated due to influences of a number of sheets to be printed, a change in environment, a printing mode (a number of sheets to be sequentially printed per one job), and a page-coverage rate, and thus a toner charging amount changes. Such a phenomenon causes problems such as a decrease in image density, occurrence of tonner fogging, and an increase in toner flying. A conventional technique, which solves such a problem, predicts a change in a charging amount of developer based on a number of sheets to be printed, a change in environment, a printing mode, and a page-coverage rate, and adjusts toner density, a development bias, a surface potential of a photoconductor, a rotational speed of a developing roller, and an output of a suction fan that collects flying toner, thus suppressing a decrease in image density, deterioration of toner fogging, and deterioration of toner flying.

However, such a technique is only a combination of individual predictions under conditions of a number of sheets to be printed, a change in environment, a printing mode, and a page-coverage rate, and thus if a plurality of conditions are changed compositively, it is difficult to sufficiently predict a charging amount of developer.

Therefore, a technique for accurately predicting a charging amount of toner is proposed. In this technique, a surface potential of a photoconductive drum before development and a surface potential of a toner layer on the photoconductive drum after development are individually measured, whereas a toner developing amount is calculated based on an image density measured result on the developed toner layer. The toner charging amount is calculated based on the measured surface potentials and toner developing amount.

In this technique, a value of an electric current flowing into the developing roller that carries developer is measured, and the measured current value is predicted as an amount of toner charges which transfer from the developing roller to the photoconductive drum. A toner developing amount is calculated based on the image density measured result on the developed toner layer. Further, a toner charging amount is calculated based on the amount of toner charges and the toner charging amount.

SUMMARY

According to one aspect of the present disclosure, an image forming apparatus includes an image carrier, a charging device, an exposing device, a developing device, a toner density detecting unit, a transfer unit, a development bias applying unit, a density detecting unit, a storage unit, and a charging amount acquisition unit. The image carrier is rotated and carries a toner image obtained by developing an electrostatic latent image which is formed on a surface of the image carrier. The charging device charges the image carrier to a predetermine charging potential. The exposing device exposes the surface of the image carrier charged to the charging potential, based on predetermined image information so as to form the electrostatic latent image, the exposing device being disposed in a rotational direction of the image carrier downstream with respect to the charging device. The developing device is disposed in a predetermined development nip portion in the rotational direction downstream with respect to the exposing device so as to oppose the image carrier. The developing device includes a developing roller that is rotated, carries developer including toner and carrier on a peripheral surface of the developing roller, and supplies the toner to the image carrier so as to form the toner image. The toner density detecting unit detects toner density of the developer in the developing device. The transfer unit transfers the toner image carried on the image carrier to a sheet. The development bias applying unit applies a development bias obtained by superimposing an alternating current voltage on a direct current voltage to the developing roller. The density detecting unit detects density of the toner image. The storage unit stores reference information in advance for each toner charging amount and each toner density, the reference information relating to a tilt of a reference straight line representing a relationship between a change amount of a frequency of the alternating current voltage of the development bias and a density change amount of the toner image in a case where the frequency is changed with a potential difference in the direct current voltage between the developing roller and the image carrier being kept constant. The charging amount acquisition unit performs a charging amount acquisition operation for forming a measurement toner image on the image carrier while changing the frequency of the alternating current voltage of the development bias with the potential difference in the direct current voltage between the developing roller and the image carrier being kept constant, acquiring a tilt of a measurement straight line representing a relationship between the change amount of the frequency and the density change amount of the measurement toner image based on the change amount of the frequency and a result of detecting density of the measurement toner image in the density detecting unit, and acquiring a charging amount of the toner included in the measurement toner image formed on the image carrier based on the acquired tilt of the measurement straight line and the reference information in the storage unit according to the toner density detected by the toner density detecting unit.

DETAILED DESCRIPTION

An image forming apparatus 10 according to an embodiment of the present disclosure will be described in detail below with reference to the drawings. The present embodiment illustrates a tandem color printer as one example of the image forming apparatus. Examples of the image forming apparatus may be a copying machine, a facsimile device, and a complex machine of them. The image forming apparatus may form a single-color (monochrome) image.

Figure 1:
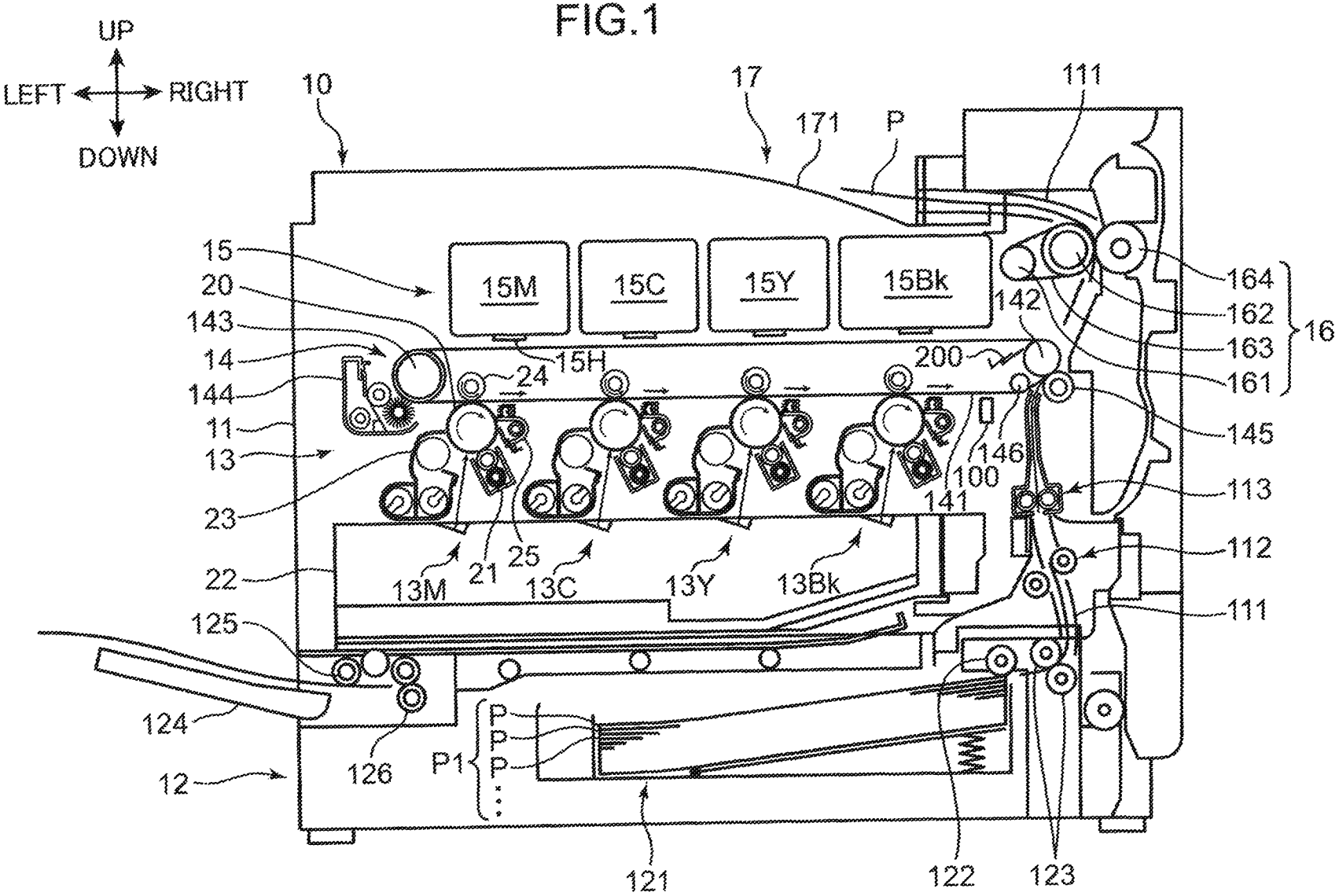
FIG. 1 is a cross-sectional view illustrating an internal structure of an image forming apparatus according to an embodiment of the present disclosure.

FIG. 1 is a cross-sectional view illustrating an internal structure of the image forming apparatus 10. The image forming apparatus 10 includes an apparatus main body 11 having a box-shaped housing structure. The apparatus main body 11 includes a sheet feeding unit 12 that feeds a sheet P, an image forming unit 13 that forms a toner image to be transferred to the sheet P fed from the sheet feeding unit 12, an intermediate transfer unit 14 (a transfer unit) that primarily transfers the toner image, a toner supply unit 15 that supplies toner to the image forming unit 13, and a fixing unit 16 that executes a fixing process for fixing an unfixed toner image formed on the sheet P to the sheet P. A sheet ejection portion 17, onto which the sheet P which has been subject to the fixing process in the fixing unit 16 is ejected, is disposed on an upper portion of the apparatus main body 11.

An operation panel, not illustrated, for inputting output conditions or the like for the sheet P is disposed on an appropriate position on an upper surface of the apparatus main body 11. The operation panel includes a power key, and a touch panel and various operation keys that are used for inputting the output conditions.

The apparatus main body 11 includes a sheet conveyance path 111 that extends vertically on a right position with respect to the image forming unit 13. A conveyance roller pair 112 that conveys a sheet to an appropriate position is disposed on the sheet conveyance path 111. A registration roller pair 113 is disposed on an upstream side of a nip portion on the sheet conveyance path 111. The registration roller pair 113 adjusts skew of a sheet and sends the sheet to the nip portion for secondary transfer, described later, at predetermined timing. The sheet conveyance path 111 is a conveyance path through which the sheet P is conveyed from the sheet feeding unit 12 to the sheet ejection portion 17 via the image forming unit 13 and the fixing unit 16.

The sheet feeding unit 12 includes a sheet feeding tray 121, a pickup roller 122, and a sheet feeding roller pair 123. The sheet feeding tray 121 is detachably attached to a lower portion of the apparatus main body 11, and a sheet bundle P1 including a plurality of laminated sheets P is stored on the sheet feeding tray 121. The pickup roller 122 feeds a top sheet P of the sheet bundle P1 stored on the sheet feeding tray 121 one by one. The sheet feeding roller pair 123 sends the sheet P fed by the pickup roller 122 to the sheet conveyance path 111.

The sheet feeding unit 12 includes a manual sheet feeding unit which is mounted to a left side surface, illustrated in FIG. 1, of the apparatus main body 11. The manual sheet feeding unit includes a bypass tray 124, a pickup roller 125, and a sheet feeding roller pair 126. The bypass tray 124 is a tray on which the sheet P to be manually fed is placed, and is opened on a side surface of the apparatus main body 11 as illustrated in FIG. 1 when the sheet P is manually fed. The pickup roller 125 feeds the sheet P placed on the bypass tray 124. The sheet feeding roller pair 126 sends the sheet P fed by the pickup roller 125 to the sheet conveyance path 111.

The image forming unit 13 forms a toner image to be transferred to the sheet P, and includes a plurality of image forming units that form toner images of different colors. In the present embodiment, the image forming units are a magenta unit 13M which uses magenta (M) developer, a cyan unit 13C which uses cyan (C) developer, a yellow unit 13Y which uses yellow (Y) developer, and a black unit 13Bk which uses black (Bk) developer. The units 13M, 13C, 13Y, and 13Bk are disposed in this order from an upstream side to a downstream side (from left to right illustrated in FIG. 1) in a rotational direction of an intermediate transfer belt 141, described later. The units 13M, 13C, 13Y, and 13Bk each have a photoconductive drum 20 (an image carrier), and a charging device 21, a developing device 23, a primary transfer roller 24, and a cleaning device 25 which are disposed around the photoconductive drum 20. An exposing device 22 which is shared by the units 13M, 13C, 13Y, and 13Bk is disposed below the image forming units.

The photoconductive drum 20 is driven to be rotated about a shaft of the photoconductive drum 20, and carries a toner image obtained by developing an electrostatic latent image which is formed on a surface of the photoconductive drum 20. Examples of the photoconductive drum 20 are a publicly-known amorphous silicon (a-Si) photoconductive drum and an organic photoconductive drum (OPC). The charging device 21 charges the surface of the photoconductive drum 20 uniformly to a predetermined charging potential. The charging device 21 includes a charging roller and a charging cleaning brush which removes toner adhered to the charging roller. The exposing device 22 is disposed downstream in the rotational direction of the photoconductive drum 20 with respect to the charging device 21, and includes various optical systems such as a light source, a polygon mirror, a reflection mirror, and a deflection mirror. The exposing device 22 irradiates the surface of the photoconductive drum 20 charged uniformly to the charging potential with light modulated based on image data (predetermined image information) and exposes the surface of the photoconductive drum 20, thus forming an electrostatic latent image.

The developing device 23 is disposed in a predetermined development nip portion NP (FIG. 3A) downstream in the rotational direction of the photoconductive drum 20 with respect to the exposing device 22 so as to oppose the photoconductive drum 20. The developing device 23 includes a developing roller 231 that is rotated to carry developer including toner and carrier on a peripheral surface of the developing roller 231 and supplies the toner to the photoconductive drum 20 so as to form the toner image.

The primary transfer roller 24 and the photoconductive drum 20 form the nip portion across the intermediate transfer belt 141 provided to the intermediate transfer unit 14. The primary transfer roller 24 primarily transfers the toner image on the photoconductive drum 20 to the intermediate transfer belt 141. The cleaning device 25 cleans the peripheral surface of the photoconductive drum 20 after the transfer of the toner image.

The intermediate transfer unit 14 is disposed in a space between the image forming unit 13 and the toner supply unit 15, and includes the intermediate transfer belt 141, a driving roller 142 which is rotatably supported to a unit frame, not illustrated, a driven roller 143, a backup roller 146, and a density sensor 100. The intermediate transfer belt 141 is an endless belt-shaped rotating body, and is installed across the driving roller 142 and the driven rollers 143 and the backup roller 146 so that a peripheral surface side of the intermediate transfer belt 141 makes contact with the peripheral surfaces of the photoconductive drums 20. The intermediate transfer belt 141 is circularly driven by the rotation of the driving roller 142. A belt cleaning device 144, which removes toner remaining on the peripheral surface of the intermediate transfer belt 141, is disposed near the driven roller 143. The density sensor 100 (the density detecting unit) is disposed downstream with respect to the units 13M, 13C, 13Y, and 13Bk so as to oppose the intermediate transfer belt 141, and detects density of the toner image formed on the intermediate transfer belt 141. In another embodiment, the density sensor 100 may detect density of a toner image on the photoconductive drum 20, or density of a toner image fixed to the sheet P.

A secondary transfer roller 145 is disposed outside the intermediate transfer belt 141 so as to oppose the driving roller 142. The secondary transfer roller 145 makes pressure-contact with the peripheral surface of the intermediate transfer belt 141 so that a transfer nip portion is formed between the secondary transfer roller 145 and the driving roller 142. The toner image, which has been primarily transferred to the intermediate transfer belt 141, is secondarily transferred to the sheet P supplied from the sheet feeding unit 12 in the transfer nip portion. That is, the intermediate transfer unit 14 and the secondary transfer roller 145 function as a transfer unit that transfers the toner image carried by the photoconductive drum 20 to the sheet P. Further, a roll cleaner 200 which is used for cleaning the peripheral surface of the driving roller 142 is disposed on the driving roller 142.

In the present embodiment, the toner supply unit 15, which stores toner to be used for forming an image, includes a magenta toner container 15M, a cyan toner container 15C, a yellow toner container 15Y, and a black toner container 15Bk. These toner containers 15M, 15C, 15Y, and 15Bk store M, C, Y, and Bk toner to be supplied, respectively. Toner of respective colors is supplied from a toner discharge port 15H formed on a container bottom surface to the developing devices 23 of the image forming units 13M, 13C, 13Y, and 13Bk corresponding to M, C, Y, and Bk.

The fixing unit 16 includes a heating roller 161 having a built-in heating source, a fixing roller 162 disposed to oppose the heating roller 161, a fixing belt 163 stretched between the fixing roller 162 and the heating roller 161, and a pressure roller 164 which is disposed to oppose the fixing roller 162 via the fixing belt 163 and forms a fixing nip portion. The sheet P supplied to the fixing unit 16 passes through the fixing nip portion so as to be heated and pressurized. This fixes the toner image transferred to the sheet P in the transfer nip portion to the sheet P.

The sheet ejection portion 17 is formed by recessing a top of the apparatus main body 11, and includes an output tray 171 that receives the sheet P ejected to a bottom portion of the recessed portion. The sheet P which has been subject to the fixing process is ejected onto the output tray 171 via the sheet conveyance path 111 which extends from an upper portion of the fixing unit 16.

<Developing Device>

Figure 2:
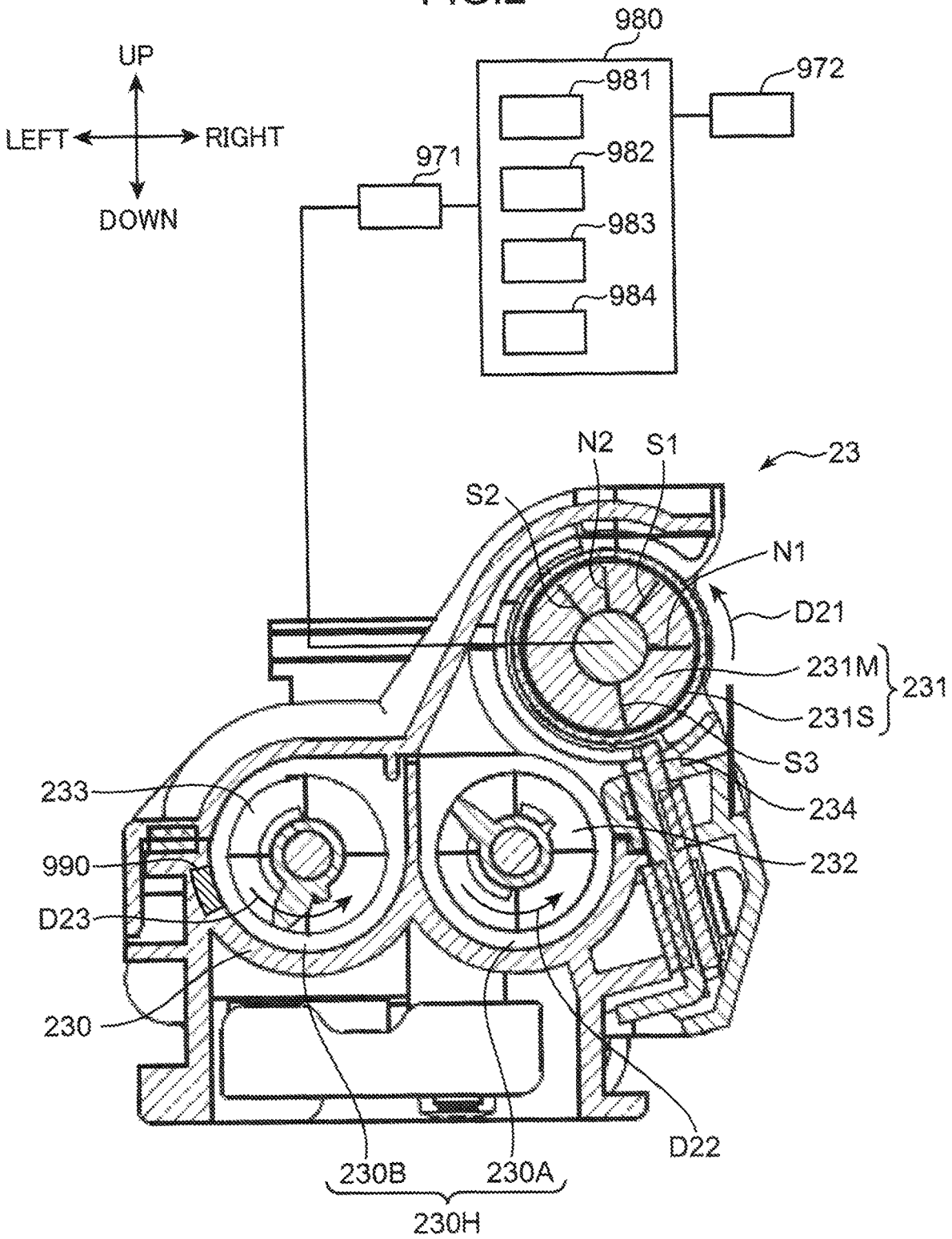
FIG. 2 is a cross-sectional view of a developing device and a block diagram illustrating an electrical configuration of a control unit according to the embodiment of the present disclosure.

FIG. 2 is a cross-sectional view of the developing device 23 and a block diagram illustrating an electrical configuration of a control unit 980 according to the present embodiment. The developing device 23 includes a development housing 230, the developing roller 231, a first screw feeder 232, a second screw feeder 233, and a regulating blade 234. The developing device 23 employs a two-component developing method.

The development housing 230 has a developer housing portion 230H. The developer housing portion 230H houses two-component developer including toner and carrier. The developer housing portion 230H includes a first conveyance portion 230A and a second conveyance portion 230B. The first conveyance portion 230A conveys the developer to a first conveyance direction from one end of a axial direction of the developing roller 231 to the other end (a direction perpendicular to a sheet surface of FIG. 2, namely, a rear-front direction). The second conveyance portion 230B, which is communicated with the first conveyance portion 230A at both the ends in the axial direction, conveys the developer to a second conveyance direction opposite to the first conveyance direction. The first screw feeder 232 and the second screw feeder 233 are rotated to directions indicated by arrows D22 and D23 in FIG. 2, respectively, so as to convey the developer to the first conveyance direction and the second conveyance direction, respectively. In particular, the first screw feeder 232 supplies the developer to the developing roller 231 while conveying the developer to the first conveyance direction.

Figure 3A:
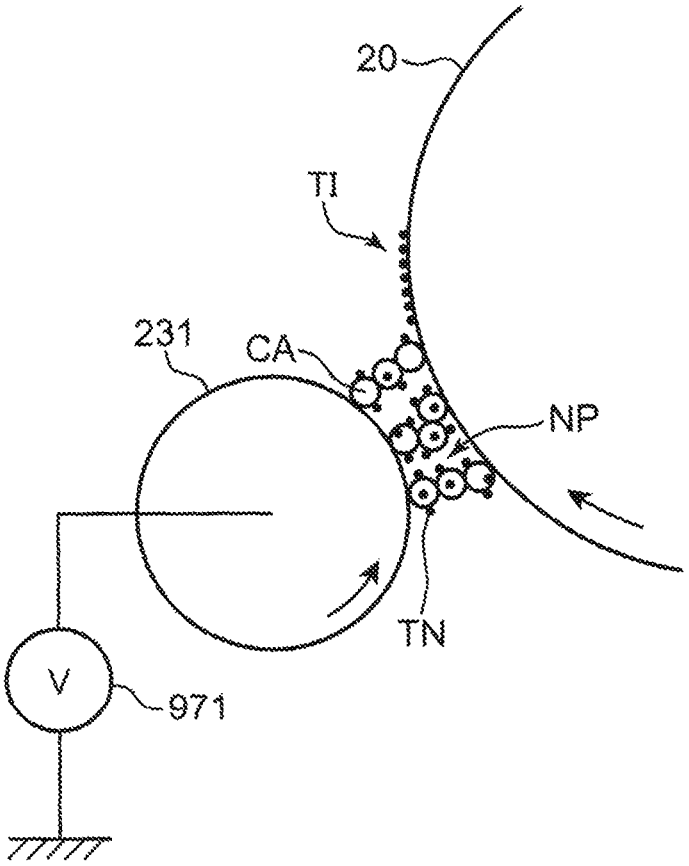
FIG. 3A is a pattern diagram illustrating a developing operation of the image forming apparatus according to the embodiment of the present disclosure.

The developing roller 231 is disposed so as to oppose the photoconductive drum 20 in the development nip portion NP (FIG. 3A). The developing roller 231 includes a sleeve 231S to be rotated, and a magnet 231M which is stationarily disposed inside the sleeve 231S. The magnet 231M has S1, N1, S2, N2, and S3 poles. The N1 pole functions as a main pole, the S1 and N2 poles function as conveyance poles, and the S2 pole functions as a peeling pole. The S3 pole functions as a draw-up and regulating pole. In one example, magnetic flux density of the S1, N1, S2, N2, and S3 poles is set to 54 mT, 96 mT, 35 mT, 44 mT, and 45 mT, respectively. The sleeve 231S of the developing roller 231 is rotated to a direction indicated by arrow D21 in FIG. 2. The developing roller 231 is rotated, receives the developer in the development housing 230, carries a developer layer, and supplies toner to the photoconductive drum 20. In the present embodiment, the developing roller 231 rotates to an identical direction (a width direction) in a position opposing to the photoconductive drum 20.

The regulating blade 234 (a layer thickness regulating member) is disposed to be away from the developing roller 231 by a predetermined space, and regulates a layer thickness of the developer supplied from the first screw feeder 232 to the peripheral surface of the developing roller 231.

The image forming apparatus 10 having the developing device 23 further includes a development bias applying unit 971, a driving unit 972, the control unit 980, and a toner sensor 990 (FIG. 2). The control unit 980 includes a central processing unit (CPU), a read only memory (ROM) that stores a control program, a random access memory (RAM) that is used as a work area of the CPU.

The development bias applying unit 971, which includes a direct-current power source and an alternating-current power source, applies a development bias, which is obtained by superimposing an alternating current voltage on a direct current voltage, to the developing roller 231 of the developing device 23 based on a control signal from a bias control unit 982, described later.

The driving unit 972, which includes a motor and a gear mechanism that transmits a torque of the motor, drives to rotate the developing roller 231, the first screw feeder 232, and the second screw feeder 233 in the developing device 23 as well as the photoconductive drum 20 during the developing operation in accordance with a control signal from a driving control unit 981, described later.

The toner sensor 990 is attached to the development housing 230 of the developing device 23. The toner sensor 990 detects toner density of developer housed in the development housing 230. In the present embodiment, the toner sensor 990, which is a magnetic permeability sensor, outputs a voltage according to the toner density to the control unit 980.

The control unit 980 is configured to include the driving control unit 981, the bias control unit 982, a storage unit 983, and a mode control unit 984 by the CPU executing the control program stored in the ROM.

The driving control unit 981 controls the driving unit 972, and drives to rotate the developing roller 231, the first screw feeder 232, and the second screw feeder 233. The driving control unit 981 controls a driving mechanism, not illustrated, and drives to rotate the photoconductive drum 20.

The bias control unit 982 controls the development bias applying unit 971 during the developing operation for supplying toner from the developing roller 231 to the photoconductive drum 20, and causes a potential difference in the direct current voltage and the alternating current voltage between the photoconductive drum 20 and the developing roller 231. The potential difference moves the toner from the developing roller 231 to the photoconductive drum 20.

The storage unit 983 stores various information to be seen by the driving control unit 981 and the bias control unit 982. An example of the stored information is a value of the development bias to be adjusted in accordance with a number of rotations of the developing roller 231 and an environment. The storage unit 983 stores reference information, which relates to a tilt of the reference straight line representing a relationship between a change amount of a frequency of the alternating current voltage of the development bias and a density change amount of the toner image in a case where the frequency is changed with the potential difference in the direct current voltage between the developing roller 231 and the photoconductive drum 20 being kept constant, for each toner charging amount in advance. Data to be stored in the storage unit 983 may be a graph or a table.

The mode control unit 984 (the charging amount acquisition unit) executes a charging amount measuring mode (a charging amount acquisition operation) and a charging amount distribution measuring mode (a charging amount distribution acquisition operation). In the charging amount measuring mode, the mode control unit 984 forms the measurement toner image on the photoconductive drum 20 while changing the frequency of the alternating current voltage of the development bias with the potential difference in the direct current voltage between the developing roller 231 and the photoconductive drum 20 being kept constant. The mode control unit 984 acquires the tilt of the measurement straight line representing the relationship between the change amount of the frequency and the density change amount of the measurement toner image based on the change amount of the frequency and a result of detecting density of the measurement toner image in the density sensor 100, and acquires the charging amount of the toner included in the measurement toner image formed on the photoconductive drum 20 based on the acquired tilt of the measurement straight line and the reference information in the storage unit 983. The mode control unit 984 performs a first charging amount acquisition operation at a first peak-to-peak voltage of the alternating current voltage of the development bias, and performs a second charging amount acquisition operation at a second peak-to-peak voltage higher than the first peak-to-peak voltage of the alternating current voltage of the development bias. The mode control unit 984 further performs a charging amount distribution acquisition operation for acquiring distribution of the toner charging amount based on the results in the first charging amount acquisition operation and the second charging amount acquisition operation.

Figure 3B:
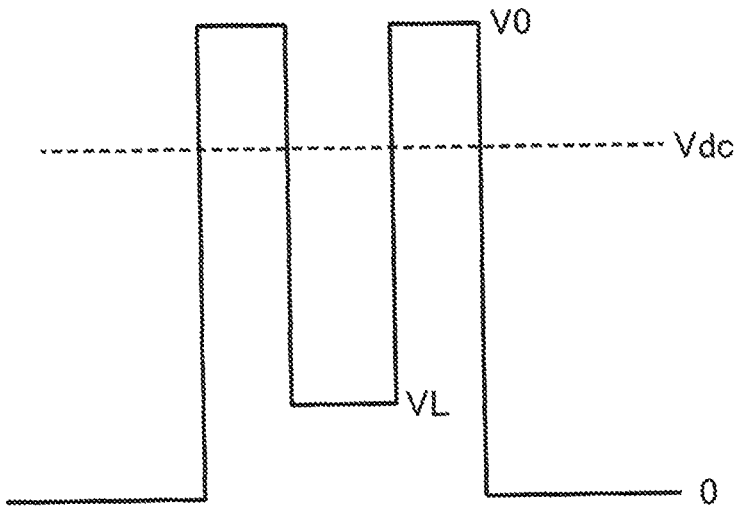
FIG. 3B is a pattern diagram illustrating a level relationship between potentials of an image carrier and a developing roller according to the embodiment of the present disclosure.

FIG. 3A is a pattern diagram of a developing operation in the image forming apparatus 10 according to the present embodiment, and FIG. 3B is a pattern diagram illustrating a level relationship in an electric potential between the photoconductive drum 20 and the developing roller 231. With reference to FIG. 3A, the development nip portion NP is formed between the developing roller 231 and the photoconductive drum 20. Toner TN and carrier CA which are carried on the developing roller 231 form a magnetic brush. In the development nip portion NP, the toner TN is supplied from the magnetic brush to the photoconductive drum 20, and a toner image TI is formed. With reference to FIG. 3B, the surface of the photoconductive drum 20 is charged to a background portion potential V0 (V) by the charging device 21. Thereafter, when the exposing device 22 emits exposure light, the surface potential of the photoconductive drum 20 is changed from the background portion potential V0 to at most an image portion potential VL (V) in accordance with the image to be printed. On the other hand, a direct current voltage Vdc of the development bias is applied to the developing roller 231, and an alternating current voltage, not illustrated, is superimposed on the direct current voltage Vdc.

In a case of such a reversal developing method, a potential difference between the surface potential V0 and the direct-current component Vdc of the development bias is a potential difference that suppresses toner fogging on the background portion of the photoconductive drum 20. On the other hand, a potential difference between a surface potential VL after exposure and the direct-current component Vdc of the development bias is a developing potential difference for moving toner of plus polarity to an image portion of the photoconductive drum 20. The alternating current voltage to be applied to the developing roller 231 improves the transfer of the toner from the developing roller 231 to the photoconductive drum 20.

On the other hand, toner is triboelectrically charged due to carrier while being circularly conveyed in the development housing 230. Each of The toner charging amounts has an effect on an amount of toner (a developing amount) moving to the photoconductive drum 20 due to the development bias. Therefore, when the toner charging amount can be accurately predicted in the image forming apparatus 10, the development bias and the toner density are adjusted in accordance with a number of sheets to be printed, a change in environment, a printing mode, and a page-coverage rate so that satisfactory image quality can be maintained. Thus, accurate prediction of the toner charging amount has been desired.

<Prediction of Toner Charging Amount>

The disclosers have continued to earnestly conduct a study in view of the above situation, and have gained a new insight that when the frequency of the alternating current voltage of the development bias is changed, the change in the toner developing amount varies depending on the toner charging amount. Specifically, when the toner charging amount is small, an increase in the frequency of the alternating current voltage causes an increase in the toner developing amount. On the other hand, the disclosers have gained a new insight that when the toner charging amount is high, an increase in the frequency of the alternating current voltage causes a decrease in the toner developing amount. With use of this characteristic, the change in the image density in the case where the frequency of the alternating current voltage is changed is measured, and thus the toner charging amount can be accurately predicted.

Figure 4:
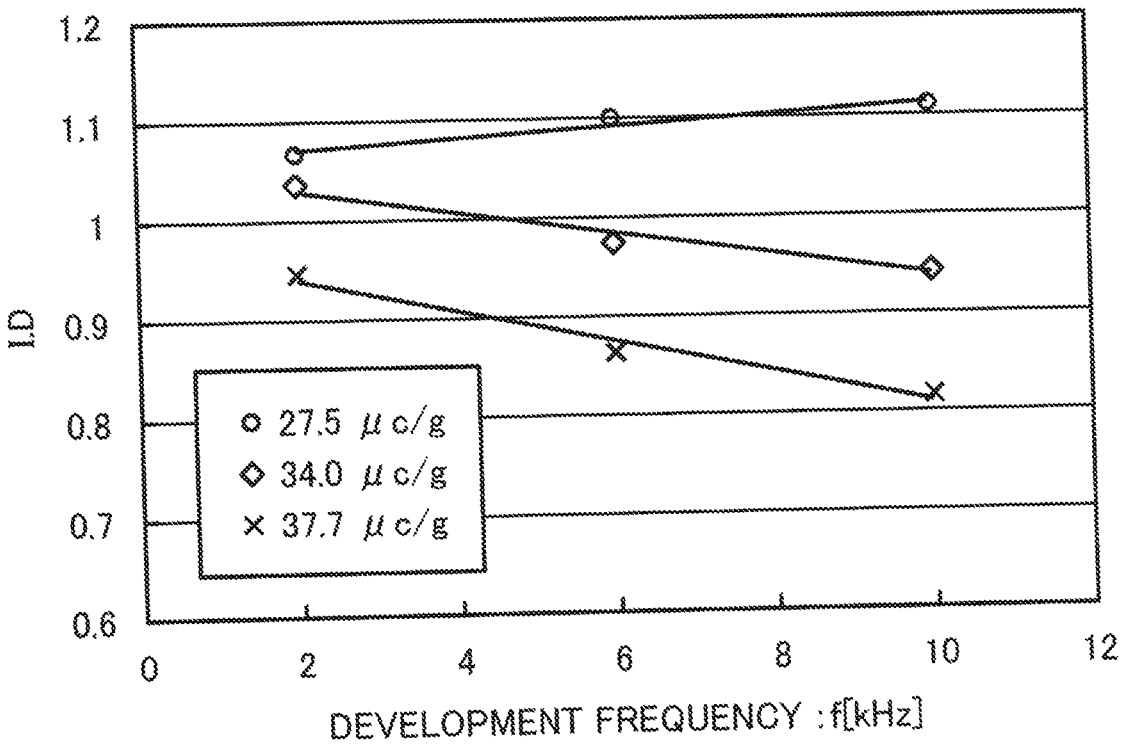
FIG. 4 is a graph illustrating a relationship between a frequency of a development bias and image density in the image forming apparatus according to the embodiment of the present disclosure.
Figure 5:
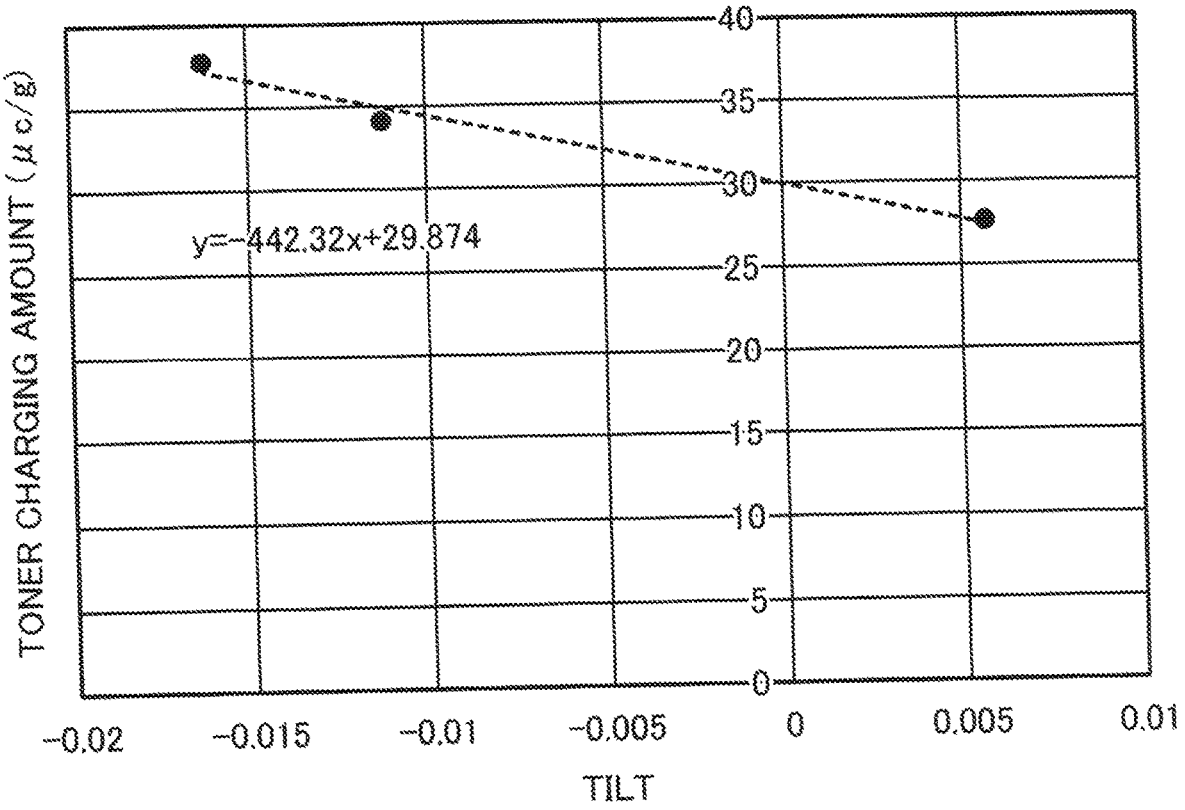
FIG. 5 is a graph illustrating a relationship between a tilt in the graph of FIG. 4 and a toner charging amount in the image forming apparatus according to the embodiment of the present disclosure.

FIG. 4 is a graph illustrating a relationship between the frequency of the development bias and the image density in the image forming apparatus 10 according to the present embodiment. FIG. 5 is a graph illustrating a relationship between the tilt in the graph of FIG. 4 and the toner charging amount in the image forming apparatus 10 according to the present embodiment.

A potential difference between the direct current voltage of the development bias to be applied to the developing roller 231 and the direct current voltage of the electrostatic latent image on the photoconductive drum 20 is kept constant, and a frequency of an alternating current voltage of the development bias is changed with a peak-to-peak voltage Vpp and a duty ratio of the alternating current voltage being fixed. This results in a tendency that the toner image density detected by the density sensor 100 varies in accordance with the toner charging amount on the developing roller 231 (FIG. 4). That is, as illustrated in FIG. 4, when the toner charging amount is 27.5 μc/g, a low frequency f causes a decrease in the image density. On the other hand, when the toner charging amounts are 34.0 μc/g and 37.7 μc/g, the low frequency f causes an increase in image density. As the toner charging amount is smaller, the tilt in the graph illustrated in FIG. 4 is greater. With reference to FIG. 5, relationships between three tilts in the graph of FIG. 4 and the respective toner charging amounts are represented by straight lines (approximation straight lines). Thus, when information illustrated in FIG. 5 is stored in the storage unit 983 in advance and the tilts of the straight lines illustrated in FIG. 4 are derived in the charging amount measuring mode, described later, the toner charging amount at that time can be measured (predicted).

<Toner Charging Amount Predicting Effect>

In the present embodiment, a surface potential sensor that measures the surface potential of the photoconductive drum 20 does not need to be disposed to predict the toner charging amount. An electric current which flows into the developing roller 231 does not need to be measured in accordance with the development bias for predicting the toner charging amount. The toner charging amount can be stably predicted without any effect of a change in the electric current flowing into the developing roller 231 due to soiling of the surface potential sensor and a change in carrier resistance. This prediction makes selection of a desirable method easy in a case where the density of an image to be printed in the image forming apparatus 10 is decreased. In one desirable method, an increase in the toner density of the developing device 23 causes a reduction in the toner charging amount and thus causes an increase in the image density. In the other method, an increase in a developing potential difference (Vdc−VL) in the development nip portion NP causes the increase in the image density.

In general, the reduction in the image density in the image forming apparatus 10 is caused by, for example, "a reduction in the developing potential difference", "a reduction in a conveyance amount of the developer passing through the regulating blade 234", "a rise in the carrier resistance", and "a rise in the toner charging amount". With such a method, the increase in the toner density for reducing the toner charging amount in response to the reduction in the image density caused by a factor other than the increase in the toner charging amount might cause a defect such as toner flying. The toner charging amount is desirably reduced by increasing the toner density in response to the reduction in the image density caused by the increase in the toner charging amount, and a developing electric field (the development bias) is desirably increased in response to the reduction in the image density caused by another factor. Acquisition of the toner charging amount enables optimization of a transfer current to be applied to the secondary transfer roller 145, thus enabling a whole system of the image forming apparatus 10 to be stable.

<Relationship between Frequency and Toner Charging Amount>

The discloser of the present disclosure estimates that the toner charging amount contributes to the change in the image density in the case where the frequency of the alternating current voltage of the development bias is changed as described below.

(1) Case of Small Toner Charging Amount

In the case of the small toner charging amount, electrostatic adhesion which acts between the toner and the carrier is small, and thus the toner is easily separated from the carrier. However, when the frequency of the alternating current voltage of the development bias is low, a number of toner reciprocating times in the development nip portion NP is decreased. This decrease causes a reduction in the image density. The decrease in the frequency increases a reciprocating distance of the toner per cycle of the alternating current voltage, but in the case of the small toner charging amount, an effect on the decrease in the image density is small because a toner moving distance is originally short. In the case of the small toner charging amount, when the frequency of the alternating current voltage of the development bias is decreased, the image density is decreased.

(2) Case of Large Toner Charging Amount

The low frequency of the alternating current voltage of the development bias decreases the number of toner reciprocating times in the development nip portion NP, but in the case of the large toner charging amount, an effect of the decrease in the number of the reciprocating times is small because originally the toner is hardly separated from the carrier. On the other hand, the low frequency increases the toner reciprocating distance per cycle of the alternating current voltage, and thus the image density increases in accordance with the large toner charging amount. In the case of the large toner charging amount, when the frequency of the alternating current voltage of the development bias is decreased, the image density increases.

<Toner Charging Amount Measuring Mode>

Figure 6:
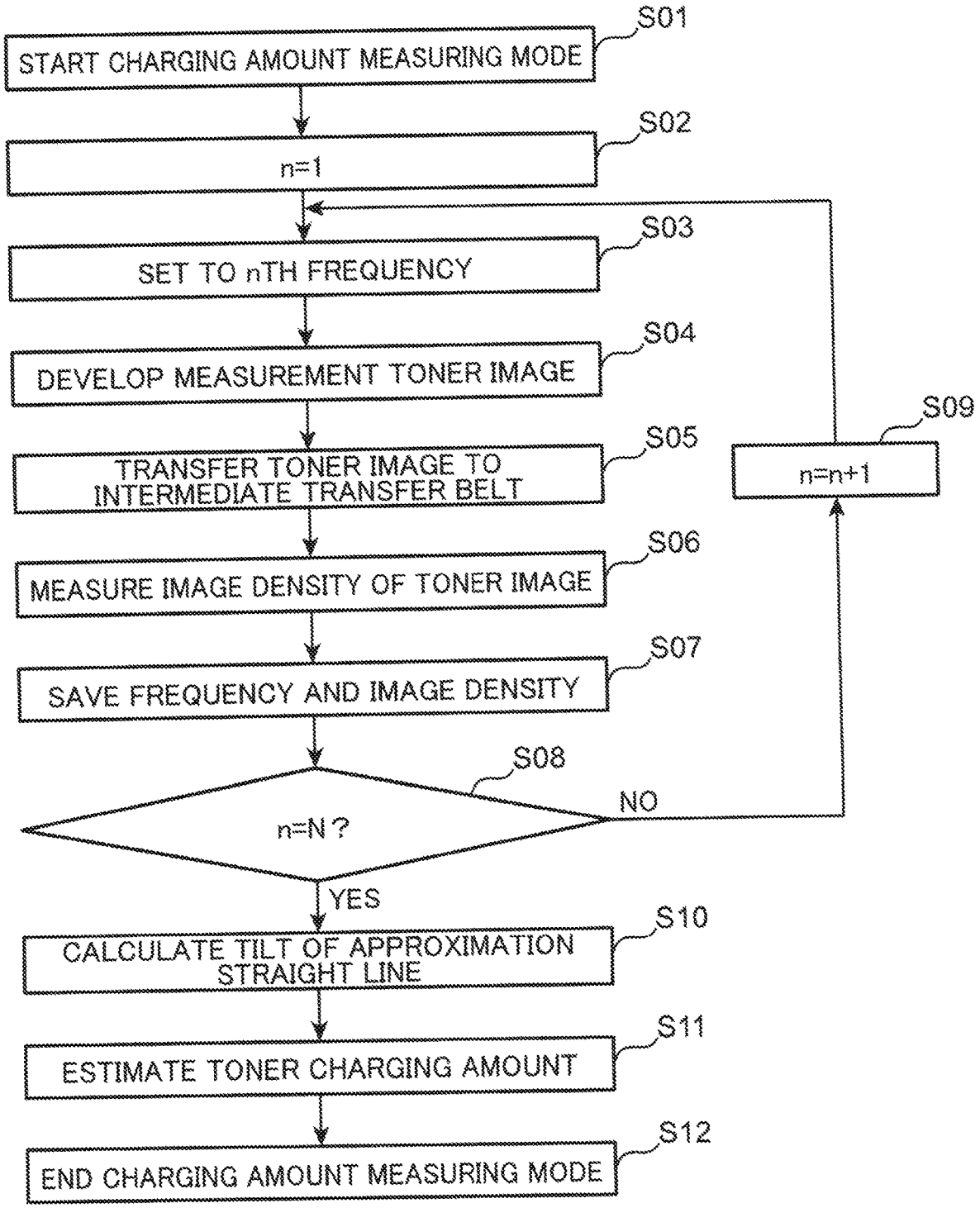
FIG. 6 is a flowchart illustrating a charging amount measuring mode to be executed in the image forming apparatus according to the embodiment of the present disclosure.
Figure 7:
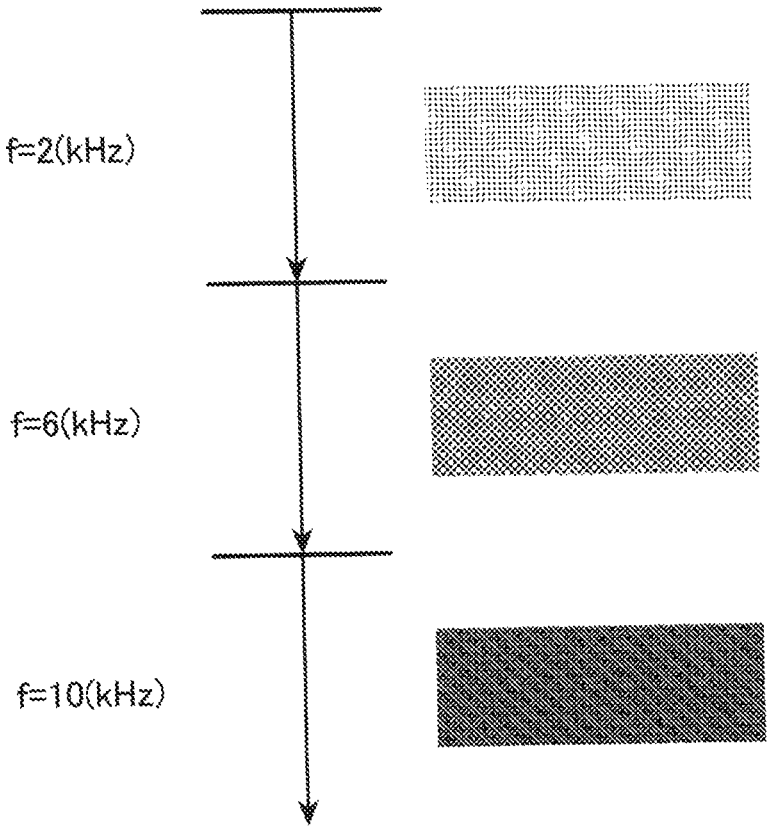
FIG. 7 is a pattern diagram illustrating a measurement toner image to be formed on the image carrier in the charging amount measuring mode to be executed in the image forming apparatus according to the embodiment of the present disclosure.

FIG. 6 is a flowchart illustrating the charging amount measuring mode to be executed in the image forming apparatus 10 according to the present embodiment. FIG. 7 is a pattern diagram of the measurement toner image to be formed on the photoconductive drum 20 in the charging amount measuring mode.

With reference to FIG. 6, when the charging amount measuring mode starts (step S01), the mode control unit 984 sets a variable n for changing the frequency of the alternating current voltage of the development bias to 1 (step S02). The mode control unit 984 controls the driving control unit 981 and the bias control unit 982, and after rotating the developing roller 231 once or more with a preset reference development bias being applied, sets the frequency of the alternating current voltage of the development bias to a first frequency (n=1) (step S03). The reference development bias is set for preventing the charging amount measuring mode from being affected by a history of previous image forming. Normally, a bias to be used for printing (image forming) is applied to a condition of the reference development bias. It is desirable that the direct current voltage and the alternating current voltage are applied in a superimposed manner because of a less eliminating effect for the history when only the direct current voltage is applied as the reference development bias.

The preset measurement toner image is developed at the development bias with which the frequency of the alternating current voltage is set to the first frequency (step S04), and this toner image is transferred from the photoconductive drum 20 to the intermediate transfer belt 141 (step S05). Image density of the measurement toner image is measured by the density sensor 100 (step S06), and the acquired image density as well as the first frequency value is stored in the storage unit 983 (step S07).

The mode control unit 984 then determines whether the variable n relating to the frequency reaches a preset prescribed number of times N (step S08). If a relation of n≠N is satisfied (NO in step S08), the value n is counted up by 1 (n=n+1 in step S09), and steps S03 to S07 are repeated. It is desirable for heightening the measuring accuracy of the charging amount that the prescribed number of times N is 2 or more, and more desirably set to satisfy a relation of 3≤N. On the other hand, if a relation of n=N is satisfied (YES in step S08), the mode control unit 984 calculates tilts of the approximation straight lines illustrated in FIG. 4 based on the information stored in the storage unit 983 (step S10). The mode control unit 984 estimates the toner charging amount from the tilts (step S11) based on the graph (the reference information), illustrated in FIG. 5, stored in the storage unit 983, and ends the charging amount measuring mode (step S12).

FIG. 7 illustrates an example that when the prescribed number of times N is 3, the frequency f is increased, and thus the image density of the measurement toner image is increased. In this case, the toner charging amount is relatively small as in 27.5 μc/g in FIG. 4.

When N is 2, the image density measured in step S06 is defined as ID1 and ID2. The first frequency is defined as f1 (kHz), and the second frequency is defined as f2 (kHz) (f2<f1). In this case, a tilt a of the straight line illustrated in FIG. 4 is calculated by expression 1.

$$\text{Tilt } a=(\text{ID1}-\text{ID2})/(f1-f2)) \quad \text{(expression 1)}$$

The tilt a, which varies with a toner charging amount, becomes "positive (+)" in the small toner charging amount, and becomes "negative (−)" in the large toner charging amount. When the measurement is conducted under the condition that 3≤N, a tilt of the approximation straight lines in a linear expression obtained by a method of least squares may be used. The reference information illustrated in FIG. 5 is expressed by expression 2.

$$Q/M=A\times\text{tilt of straight line}+B \quad \text{(expression 2)}$$

Symbols A and B are values specific to developer, and are determined in advance by an experiment. Symbol Q/M means the toner charging amount per unit mass. When the tilt a of the approximation straight line calculated by the expression 1 in step S10 is assigned into the expression 2, the toner charging amount Q/M is calculated. The charging amount measuring mode illustrated in FIG. 6 may be executed for the developing devices 23 of the respective colors in FIG. 1, and the frequency set during the mode may be set to values specific to the developing devices 23. In particular, when desirable frequencies in accordance with temperature and humidity around the image forming apparatus 10 and a number of durable sheets have been already known, the frequency to be set during the mode may be set near the already known frequency. A frequency to be used for a new measuring mode may be selected with reference to the result of the charging amount measuring mode for the previous toner. In this case, the accuracy of the toner charging amount to be measured can be heightened.

<Execution Timing of Charging Amount Measuring Mode>

The charging amount measuring mode according to the present embodiment is automatically started and manually started at different timings. It is desirable that the automatic measuring mode is executed at the same timing as a calibration operation by the image forming apparatus 10 (referred to also as a setting-up operation or an image quality adjusting operation). In the calibration operation, the adjusting operation is sufficiently performed for obtaining satisfactory image quality in an intermediate density region (a halftone image). For this operation, a time period required by executing the charging amount measuring mode is sufficiently secured. Therefore, the measuring mode can be executed at the alternating current voltage of the development bias with two different frequencies. In the calibration operation, a halftone image as well as a solid image (100% solid image) is also used as an image pattern for adjusting the image quality. Thus, the predicting accuracy of the toner charging amount can be improved. In the solid image in a high density region, a developing performance in the development nip portion NP is saturated more easily than that in the halftone image. That is, a change amount of the image density is small in the case where the development bias is changed (a sensitivity is low). On the other hand, in the halftone image, the toner charging amount is accurately measured (predicted) because the change amount of the image density is comparatively large. In the case of the halftone image, the density sensor 100 might detect the image density with comparatively low accuracy because the density is relatively low in the halftone image than in the solid image. Therefore, the charging amount measuring mode is executed for both the solid image and the halftone image, and an average value is taken from these images, thus enabling the measurement with higher accuracy. The values A and B in the expression 2 are different between the solid image and the halftone image. This is because a relationship between the image density and the toner developing amount is different between the solid image and the halftone image.

It is desirable that a plurality of the density sensors 100 are disposed in a main scanning direction (the axial direction of the photoconductive drum 20) and measurement toner images are formed in accordance with the positions of the density sensor 100. That is, in a case where a measurement toner image is formed corresponding to both the ends in the axial direction of the photoconductive drum 20, the toner charging amounts at both the ends of the developing device 23 (the developing roller 231), respectively, can be predicted. If a difference in the toner charging amount between both the ends is larger than a preset threshold, charging performance might be deteriorated in the developing device 23. The mode control unit 984 thus can facilitate replacement of the developing device 23 and replacement of developer through a display unit, not illustrated, of the image forming apparatus 10.

It is desirable that the toner charging amount measuring mode is executed when the image forming apparatus 10 is manufactured and is shipped from a factory and when the main body of the image forming apparatus 10 is set up in a place where the image forming apparatus 10 is used. This enables prediction of an influence during suspension of the image forming apparatus 10. That is, the charging amount of the developer tends to be small when the suspension period is long, and a tendency level varies with a period and an environment in which the image forming apparatus 10 is left. Therefore, the measurement of the toner charging amount at the shipment time and the main body setup time enables prediction of a deteriorated state of the developer due to the state that the developer is left. If the image forming apparatus 10 is left for a very long period or left in a hostile environment, a great difference between the two toner charging amounts (the toner charging amounts at the shipment time and the main body setup time) is detected. In such a case, replacement of the developer can be facilitated in the place of use, similarly as described above.

On the other hand, even if the toner charging amounts at the shipment time and the main body setup time are small, the developer is less likely to be deteriorated when the difference between the toner charging amounts is small. Thus, the developer does not have to be replaced in the place of use, and adjustment of the toner density and a developing condition (the development bias, etc.) can improve image quality. The toner charging amount measuring mode according to the present embodiment is executed after the image forming apparatus 10 is not used and left for a predetermined time period, thus acquiring a change in state of the developer.

In the toner charging amount measuring mode according to the present embodiment, the toner charging amounts in the developing devices 23 can be acquired without using the surface potential sensor that measures potentials on the photoconductive drum 20 and an ammeter that measures developing currents flowing into the developing rollers 231. Even in a case where the toner density of the developer in the developing device 23 fluctuates, the toner charging amount can be accurately acquired by referring to the reference information according to the toner density. The acquired results enable an accurate determination whether the replacement of the developer in the developing devices 23 is necessary and an accurate determination whether adjustment of the development bias is necessary.

In particular, the reference information, which relates to a predetermined toner density and is stored in the storage unit 983, is set such that when the toner charging amount is the first charging amount, the tilt of the reference straight line is negative, when the toner charging amount is the second charging amount smaller than the first charging amount, the tilt of the reference straight line is positive, and as the toner charging amount becomes smaller, the tilt of the reference straight line is greater. Such a configuration enables the accurate toner charging amounts to be acquired based on a relationship between the frequency of the alternating current voltage of the development bias and the density of toner images (the development toner amount) to be formed on the photoconductive drums 20 (the intermediate transfer belt 141).

<Toner Charging Amount Distribution Measuring Mode>

Figure 8:
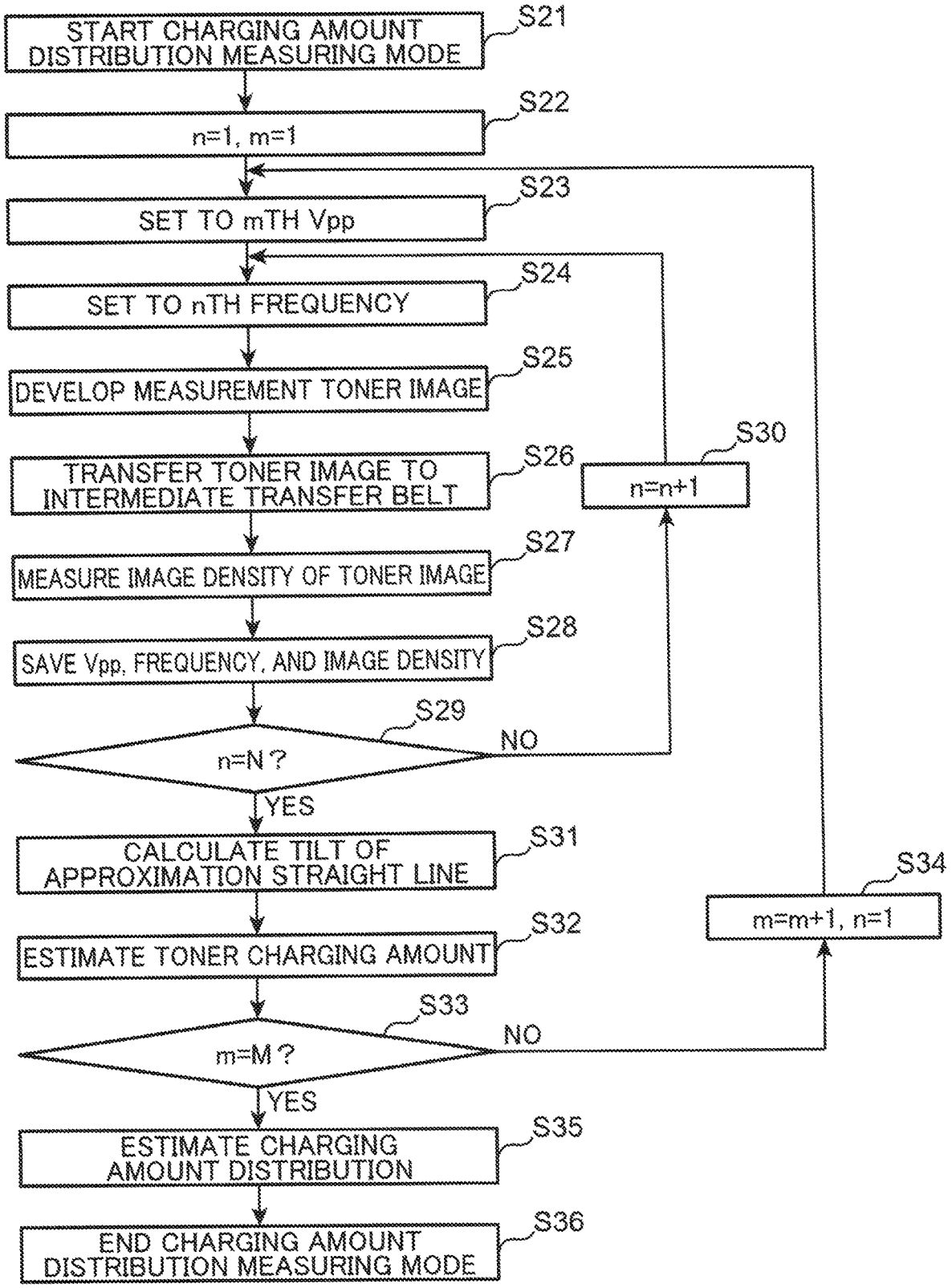
FIG. 8 is a flowchart illustrating a charging amount distribution measuring mode to be executed in the image forming apparatus according to the embodiment of the present disclosure.
Figure 9:
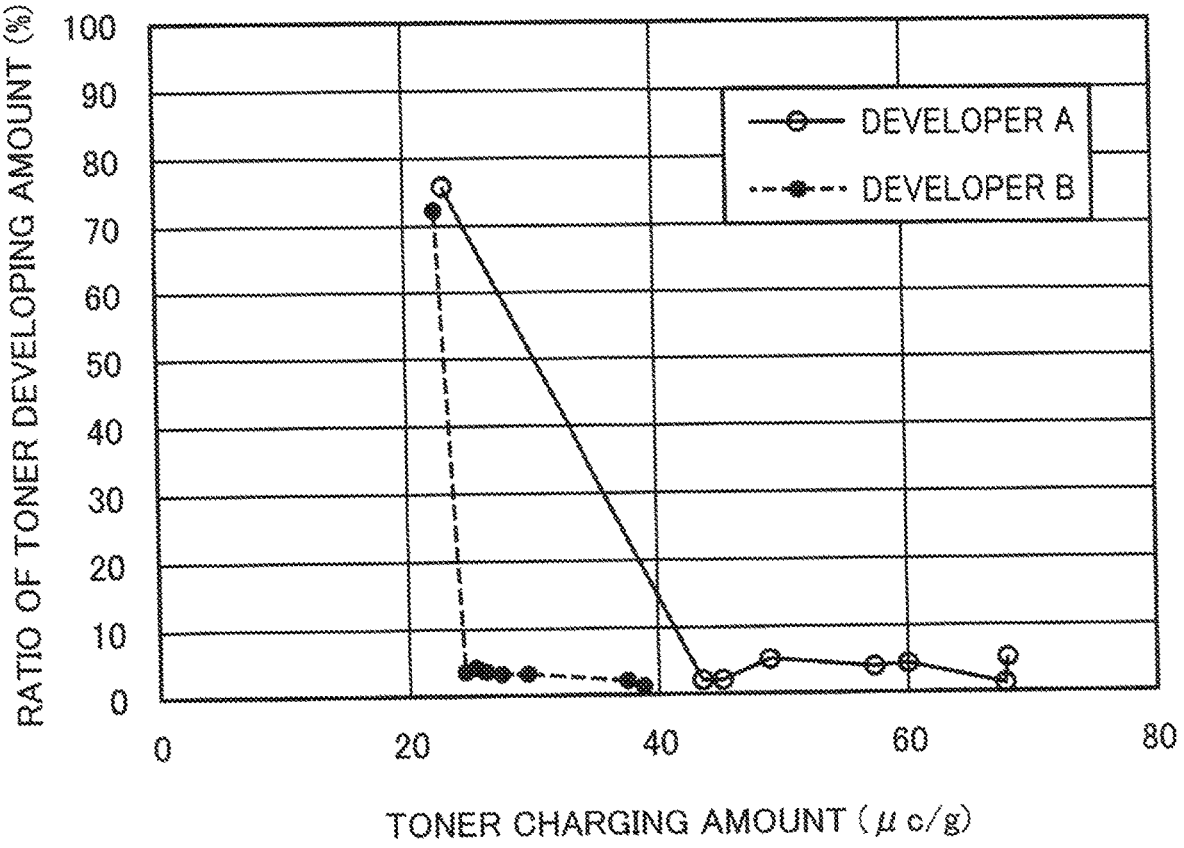
FIG. 9 is a graph illustrating a relationship between the toner charging amount and a ratio of a toner developing amount in the image forming apparatus according to the embodiment of the present disclosure.

In the present embodiment, the mode control unit 984 can execute the charging amount distribution measuring mode in which a toner charged state more detailed than the charging amount measuring mode can be detected. FIG. 8 is a flowchart illustrating the charging amount distribution measuring mode to be executed in the image forming apparatus 10 according to the present embodiment. FIG. 9 is a graph illustrating a relationship between the toner charging amount and a ratio of a toner developing amount in the image forming apparatus 10 according to the present embodiment.

With reference to FIG. 8, If the charging amount distribution measuring mode starts (step S21), the mode control unit 984 sets the variable n for changing the frequency of the alternating current voltage of the development bias to 1, and sets a variable m for changing the peak-to-peak voltage Vpp of the alternating current voltage to 1 (step S22). After rotating the developing roller 231 once or more with a preset reference development bias being applied, the mode control unit 984 sets the alternating current voltage Vpp of the development bias to a first Vpp (m=1) (step S23). The mode control unit 984 sets the frequency of the development bias to the first frequency (n=1) (step S24). Herein, the reference development bias is set for preventing the charging amount measuring mode from being affected by a history of previous image forming, and normally a bias at a time of use for printing (image forming) is employed.

Then, the measurement toner image set in advance at the first Vpp and with the first frequency is developed (step S25), and this toner image is transferred from the photoconductive drum 20 to the intermediate transfer belt 141 (step S26). The image density of the measurement toner image is measured by the density sensor 100 (step S27), and is stored in the storage unit 983 together with the first Vpp and the first frequency (step S28).

The mode control unit 984 then determines whether the variable n relating to the frequency reaches the preset prescribed number of times N (step S29). Herein, if a relation of $n \neq N$ is satisfied (NO in step S29), the value n is counted up by 1 (n=n+1 in step S30), and steps S24 to S28 are repeated. It is desirable for heightening the measuring accuracy of the charging amount distribution that the prescribed number of times N is 2 or more, and more desirably is set to satisfy a relation of 3≤N. On the other hand, if a relation of n=N is satisfied (YES in step S29), the mode control unit 984 calculates tilts of the approximation straight lines illustrated in FIG. 4 based on the information stored in the storage unit 983 (step S31). The mode control unit 984, then, estimates the toner charging amounts in the case where m=1 from the tilts based on the graph (the reference information), illustrated in FIG. 5, stored in the storage unit 983 (step S32).

The mode control unit 984 determines whether the variable m relating to the voltage Vpp reaches the preset prescribed number of times M (step S33). If a relation of m≠M is satisfied (NO in step S33), the value m is counted up by 1 (m=m+1) to satisfy a relation of n=1 (step S34), and steps S23 to S32 are repeated. It is desirable for heightening the measuring accuracy of the charging amount distribution that the prescribed number of times M is 3 or more, and more desirably is set to satisfy a relation of 5≤M. On the other hand, if a relation of m=M is satisfied (YES in step S33), the mode control unit 984 estimates the toner charging amount distribution from the toner charging amounts corresponding to the respective voltages Vpp based on the information stored in the storage unit 983 (step S35). The mode control unit 984 then ends the charging amount distribution measuring mode (step S36).

In the charging amount measuring mode, the mode control unit 984 changes only the frequencies with the voltages Vpp being fixed so as to estimate and measure the toner charging amounts. This case is conditional upon a state that all the toner charging amounts in the developing devices 23 are the same (average). Normally, states of the developer in the developing devices 23 can be sufficiently acquired even based on the toner charging amounts estimated under such a condition. On the other hand, in the charging amount distribution measuring mode, employment of a method for further heightening the voltage Vpp gradually enables measurement of the toner charging amount distribution. In other words, in the flow illustrated in FIG. 8, frequency dependence characteristics of the image density are acquired at a low voltage Vpp. In this case, highly charged toner is hardly separated from the carrier, and thus low-charged toner is mainly developed on the photoconductive drum 20. The toner charging amount can be predicted (FIG. 5) from "the change in image density/the change in frequency" at this time (FIG. 4). At this time, the mode control unit 984 stores image density with a frequency to be used for the image forming operation (6 kHz in tables 1 and 2, described later) in the storage unit 983. The mode control unit 984 then increases the voltage Vpp, and acquires the frequency dependence characteristics of the image density similarly in the above method. As a result, the toner charging amounts to be acquired become slightly large, and the image density is also heightened.

When such a process is repeated for different voltages Vpp at a plural number of times, graphs (plural pieces of information) representing a relationship between a toner charging amount Q/M and image density ID are acquired. Herein, the mode control unit 984 converts the image density ID into a development toner amount TM on the intermediate transfer belt 141 based on the data stored in the storage unit 983 in advance, and calculates a value QT (=the toner charging amount Q/M×the development toner amount TM) of the measured data for each voltage Vpp so as to obtain a difference ΔQT between this value QT and a value QT at a previous voltage Vpp (ΔQT=QT(n)−QT(n−1): n is a natural number). Similarly, as for the development toner amount TM, the mode control unit 984 obtains a difference ΔTM between the development toner amount TM and a development toner amount TM at a previous voltage Vpp (ΔTM=TM(n)−TM (n−1): n is a natural number). The mode control unit 984 then divides the difference ΔQT by the difference ΔTM, and calculates a difference in (the toner charging amount Q/M×the development toner amount TM)/(the difference in the development toner amount TM)=ΔQT/ΔTM=a calculated toner charging amount Q/Mcal (tables 1 and 2) for each voltage Vpp.

In such a manner, in the present embodiment, the charging amount acquisition operation is performed on the peak-to-peak voltages of the plurality of alternating current voltages, and thus the toner charging amount distribution can be acquired.

In the present embodiment, the mode control unit 984 improves accuracy of the charging amount measuring mode and the charging amount distribution measuring mode in accordance with the toner density in the developing device 23. In the present embodiment, the toner density of the developer housed in the developing device 23 is adjusted in accordance with an output from the toner sensor 990. That is, when the toner density detected by the toner sensor 990 is higher than preset target density (for example, 8%), the toner supply from the toner supply unit 15 is suspended. On the other hand, when the toner density detected by the toner sensor 990 is lower than the target density, a predetermined amount of the toner is supplied from the toner supply unit 15 to the developing device 23. In such a manner, the toner is consumed from the developing device 23 to the photoconductive drum 20, and the amount of toner supplied from the toner supply unit 15 is adjusted in accordance with an output from the toner sensor 990. Due to this adjustment, the toner density in the developing device 23 remains within a predetermined fluctuation range including the target density while fluctuating.

On the other hand, the toner density might affect the developing amount of the toner from the developing device 23 to the photoconductive drum 20. In the charging amount measuring mode and the charging amount distribution measuring mode, the toner charging amount is predicted by using the developing amount, and thus the toner charging amount might be affected by the toner density. In particular, in a case of the developer in which the change in the toner charging amount is large in accordance with the toner density, it is desirable that correction on the toner density is made.

Figure 10:
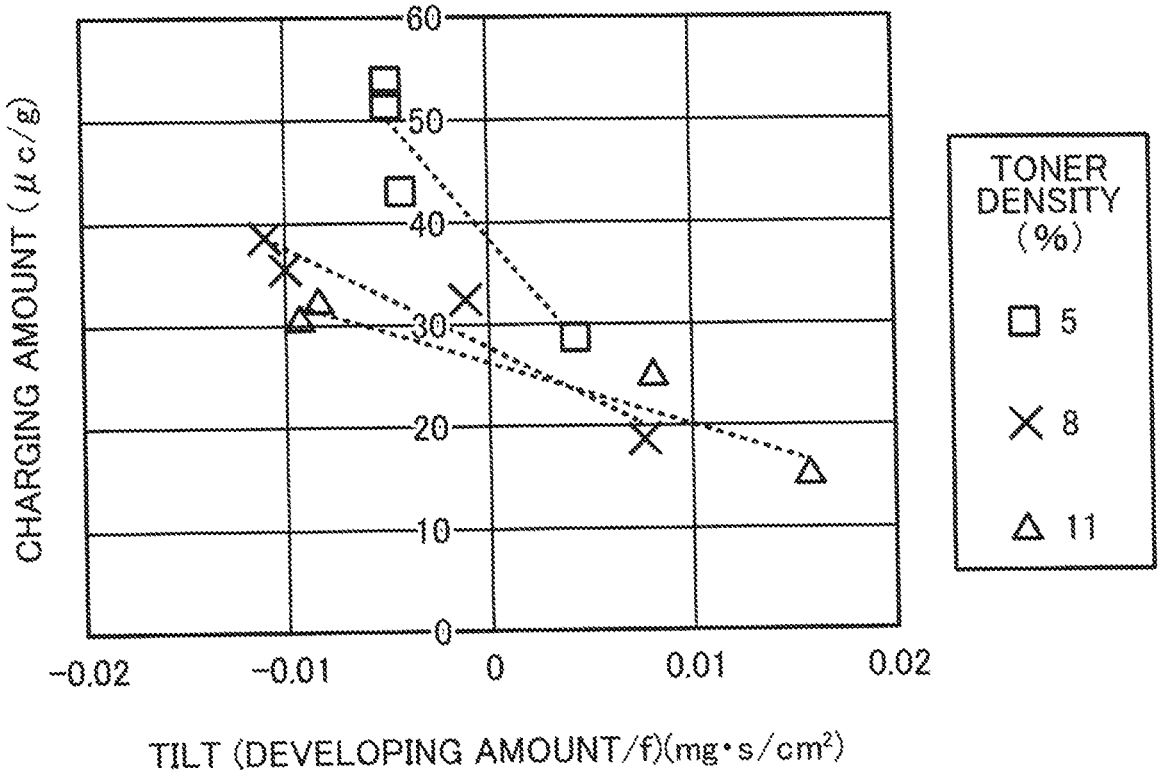
FIG. 10 is a graph illustrating a relationship between a tilt of a reference straight line representing a relationship between the toner developing amount and the frequency of the development bias and a toner charging amount in the image forming apparatus according to the embodiment of the present disclosure.

FIG. 10 is a graph (a toner density correction straight line) illustrating a relationship between a tilt of a reference straight line representing a relationship (ratio) between the toner developing amount and the frequency f of the development bias and a toner charging amount in the image forming apparatus 10 according to the present embodiment. That is, a horizontal axis in FIG. 10 represents the tilt of the reference straight line in FIG. 4, and corresponds to the tilt a in the expression 1. On the other hand, a vertical axis in FIG. 10 is similar to the vertical axis in FIG. 5 and corresponds to the toner charging amount Q/M calculated by the expression 2. In other words, FIG. 10 corresponds to the graph in which the toner density is varied and the graph in FIG. 5 is expressed by the varied toner density. In FIG. 10, the toner density is set to 5%, 8%, and 11%. As illustrated in FIG. 10, in a portion where the toner density is 8% to 11%, namely, high, the relationship between the tilt and the toner charging amount hardly changes. On the other hand, in a portion where the toner density is 5%, namely, low, even if the tilt of the reference straight line is the same, the toner charging amount is large. Specifically, when the tilt is 0, the toner charging amount is 28 (μc/g) with the toner density of 8% to 11%, but is 38 μc/g with the toner density of 5%. Thus, in the charging amount measuring mode and the charging amount distribution measuring mode, it is desirable that a "tilt to charging amount" conversion expression (constants A and B in the expression 2) is adjusted in accordance with the toner density. The constants A and B in this conversion expression vary with a type of developer, and thus the constants A and B are stored in the storage unit 983 in advance in accordance with developer to be used.

Accordingly, the mode control unit 984 calculates the tilt a based on the expression 1 in step S10 in the charging amount measuring mode (FIG. 6), and acquires the constants A and B according to the toner density from the storage unit 983 by referring to the toner density detected by the toner sensor 990 when the toner charging amount is estimated in step S11. The acquired constants A and B are assigned to the expression 2, and the toner charging amount Q/M is calculated based on the tilt a. Thus, even when the toner density of the developer in the developing device 23 fluctuates, the toner charging amount can be accurately acquired by referring to the reference information according to the toner density, while an influence of the toner density is being suppressed.

Much the same is true on the charging amount distribution measuring mode. That is, in step S32 of FIG. 8, when the toner charging amount is estimated, the mode control unit 984 refers to the toner density detected by the toner sensor 990, and acquires the constants A and B according to the toner density from the storage unit 983. The acquired constants A and B are assigned to the expression 2, and the toner charging amount Q/M is calculated based on the tilt a. As a result, while the influence of the toner density is being suppressed, the toner charging amount distribution in the developing device 23 can be accurately predicted (acquired).

With reference to FIG. 10, the reference information stored in the storage unit 983 (the constants A and B) is approximately identical with toner density of 8% and 11% in the graph of FIG. 10, and thus the reference information may be fixed values in a first region where the toner density is a predetermined threshold or more (for example, 8% or more). On the other hand, in a second region where the toner density is less than the threshold (for example, 5% or more and less than 8%), the toner charging amount with respect to a predetermined tilt of the reference straight line is set to be higher than that in the first region, and the tilt of the toner density correction straight line illustrated in FIG. 10 is steeper than that in the first region. The toner density correction straight lines in both the regions tilt toward a minus side such that as the tilt of the reference straight line (the horizontal axis in FIG. 10) is greater, the toner charging amount (the vertical axis in FIG. 10) is smaller. Therefore, when the toner density is in the second region, the toner charging amount can be accurately acquired by referring to the reference information according to the toner density.

In the present embodiment, the relationship between the tilt of the reference straight line and the toner charging amount is corrected in accordance with the toner density in the developing device 23, and thus the toner charging amount and the charging amount distribution can be accurately acquired without being affected by the toner density.

EXAMPLES

The embodiment of the present disclosure will be further described in detail below by giving examples, but the present disclosure is not limited only to the following examples. Experimental conditions in conducted comparative experiments are described below.

<Common Experimental Conditions>

- Printing speed: 55 sheets/minute
- The photoconductive drum 20: amorphous silicon photoconductor (α-Si)
- The developing roller 231: outer diameter; 20 mm, surface shape; knurled grooving, 80 rows of recessed portions (grooves) are formed along the circumferential direction.
- The regulating blade 234: made of SUS430, magnetic property, thickness; 1.5 mm
- Developer conveyance amount after the regulating blade 234: 250 g/m$^2$
- Circumferential velocity of the developing roller 231 with respect to the photoconductive drum 20: 1.8 (a trailing direction in an opposing position)
- The distance between the photoconductive drum 20 and the developing roller 231: 0.30 mm
- White portion (background portion) potential V0 on the photoconductive drum 20: +270 V
- Image portion potential VL on the photoconductive drum 20: +20 V
- The development bias of the developing roller 231: an alternating current voltage square wave in which frequency=6.0 kHz, Duty=50%, and Vpp=1000 V, Vdc (the direct current voltage)=200 V
- Toner: positively charged toner, volume average particle size; 6.8 μm, toner density; 8%
- Carrier: volume average particle size; 35 μm, ferrite resin coated carrier <Experiment 1>

Under the above conditions, the toner charging amount was adjusted by changing an amount of toner external additive, and the printing operation was performed. Results of the experiment 1 are illustrated in FIGS. 4 and 5. In FIG. 4, the image density of the toner image on the intermediate transfer belt 141 was measured by the density sensor 100, and the toner image density is represented as I.D of a toner fixed image by using a correlation curve indicating a correlation between image density (a sensor output), which was acquired in advance, of the toner image and the image density of the toner fixed image formed on a printing sheet (paper).

FIG. 5 illustrates a relationship between the toner charging amounts and the tilts of the straight lines (the approximation straight lines) in FIG. 4. Expression 3 (described below) of the approximation straight lines illustrated in FIG. 5 is stored in the storage unit 983 in advance. Use of this expression 3 enables prediction of the toner charging amount.

$$\text{Toner charging amount } Q/M\ (\mu c/g) = -442.32 \times \text{tilt} + 29.87 \quad \text{(Expression 3)}$$

In the expression 3, the tilt=Δ image density/Δ frequency (see the tilts in the graph of FIG. 4)

<Experiment 2>

An experiment relating to the charging amount distribution measuring mode was conducted. The condition of carrier coating agent was changed for preparing developer A and developer B that indicate different charging amount distributions. The toner density was 8% for both the developer A and the developer B. The condition of the development bias was the same as the condition in the experiment 1 except for the voltage Vpp and the frequency.

<Developer>

It was confirmed that pulverized toner and core-shell toner produced a similar effect. It was confirmed that a similar effect was produced at the toner density ranging from 3% to 12%. Toner transfer is caused by an alternating electric field notably when a finer magnetic brush is used. Thus, the volume average particle size of the carrier is preferably 45 μm or less, and more preferably 30 μm or more to 40 μm or less. Resin carrier is more preferable because its true specific gravity is smaller than that of ferrite carrier.

<Carrier>

The carrier was formed by coating a ferrite core having volume average particle size of 35 μm with silicon or fluorine, specifically in the following procedure. 20 parts by mass of silicon resin KR-271 (Shin-Etsu Chemical Co., Ltd.) was dissolved in 200 parts by mass of toluene, and thus an application liquid was prepared for 1000 parts by weight of carrier core EF-35 (made by Powdertech Co., Ltd.). After a fluid bed coating applicator sprayed the application liquid to the carrier core EF-35, and the carrier core EF-35 coated with the application liquid was heated at 200° C. for 60 minutes so that carrier was obtained. In this application liquid, a conductive agent and a charge control agent were mixed within a range between 0 to 20 parts by mass with respect to 100 parts by mass of coating resin and were dispersed. In such a manner, resistance and charging were adjusted.

Table 1 indicates experimental results in the developer A, and Table 2 indicates experimental results in the developer B. The charging amounts in Tables 1 and 2 were measured by using a suction-type small-sized charging amount measuring device MODEL212HS manufactured by Trek, Inc.

TABLE 1

DEVELOPER A

| Vpp (kV) | CHARGING AMOUNT (μc/g) | DEVELOPING AMOUNT WITH 6 kHz (mg/cm$^2$) | CALCULATED CHARGING AMOUNT (μc/g) | DEVELOPING AMOUNT RATIO WITH 6 kHz (%) |
|---|---|---|---|---|
| 0.2 | 23 | 0.25 | 23.0 | 75.8 |
| 0.3 | 23.6 | 0.257 | 43.5 | 2.4 |
| 0.4 | 24.2 | 0.265 | 45.0 | 2.1 |
| 0.6 | 25.6 | 0.281 | 48.8 | 4.8 |
| 0.8 | 27 | 0.294 | 57.3 | 3.9 |
| 1 | 28.6 | 0.309 | 60.0 | 4.5 |
| 1.2 | 29.1 | 0.313 | 67.7 | 1.2 |
| 1.4 | 31.1 | 0.33 | 67.9 | 5.2 |

TABLE 2

DEVELOPER B

| Vpp (kV) | CHARGING AMOUNT (μc/g) | DEVELOPING AMOUNT WITH 6 kHz (mg/cm$^2$) | CALCULATED CHARGING AMOUNT (μc/g) | DEVELOPING AMOUNT RATIO WITH 6 kHz (%) |
|---|---|---|---|---|
| 0.2 | 22.4 | 0.24 | 22.4 | 72.7 |
| 0.3 | 22.5 | 0.252 | 24.5 | 3.6 |
| 0.4 | 22.7 | 0.263 | 25.2 | 3.9 |
| 0.6 | 23 | 0.268 | 26.0 | 3.6 |
| 0.8 | 23.1 | 0.281 | 27.3 | 3.3 |
| 1 | 23.5 | 0.289 | 29.3 | 3.3 |
| 1.2 | 23.6 | 0.301 | 37.5 | 2.4 |
| 1.4 | 23.8 | 0.312 | 38.8 | 1.5 |

In both the experiments, the experimental results are the toner developing amounts obtained by converting the image density in the case where the frequency of the alternating current voltage of the development bias is set to 6 kHz in accordance with a linear conversion expression stored in the storage unit 983 in advance. The charging amount distributions in the developer A and the developer B are illustrated in FIG. 9. FIG. 9 illustrates a ratio of development toner amount for each voltage Vpp on condition that the amount of toner developed in a relation of Vpp=1.4 kV is 100%.

A "developing amount ratio with frequency of 6 kHz" indicated in Tables 1 and 2 will be described. For example, the "developing amount ratio with frequency of 6 kHz" at the voltage Vpp of 0.3 (kV) is calculated according to {(developing amount at the development bias with voltage Vpp 0.3 (kV) and frequency of 6 (kHz))−(developing amount at the development bias with voltage Vpp 0.2 (kV) and frequency of 6 (kHz))}/(developing amount at the development bias with voltage Vpp 1.4 (kV) and frequency of 6 (kHz))×100(%). Herein, the voltage Vpp 1.4 (kV) is a maximum voltage Vpp within the measurement range. Similarly, the "developing amount ratio with frequency of 6 kHz" at the voltage Vpp 0.4 (kV) is calculated according to {(developing amount at the development bias with voltage Vpp 0.4 (kV) and frequency of 6 (kHz))−(developing amount at the development bias with voltage Vpp 0.3 (kV) and frequency of 6 (kHz))}/(developing amount at the development bias with voltage Vpp 1.4 (kV) and frequency of 6 (kHz))×100(%). Much the same is true on the other voltages Vpp, but in a case of a minimum voltage Vpp 0.2 (kV), the "developing amount ratio with frequency of 6 kHz" is calculated according to (the developing amount at the development bias with voltage Vpp 0.2 (kV) and frequency of 6 (kHz))/(the developing amount at the development bias with voltage Vpp 1.4 (kV) and frequency of 6 (kHz))×100(%). A developer ratio (%) calculated in such a manner is plotted along a vertical axis in FIG. 9.

With reference to FIG. 9, it is found from the result in the charging amount distribution measuring mode that the developer A includes toner larger in the charging amount than the developer B, and the charging distribution is wide. On the other hand, the developer B shows narrow charging distribution, and the toner charging amounts are approximate to each another. Such tendency is measured during use of the image forming apparatus 10, and thus a deteriorated state of the developer can be acquired. This enables secure determination whether replacement of developer is necessary.

The embodiment of the present disclosure has been described as above, but the present disclosure is not limited to the embodiment and thus includes following modifications.

(1) In the above embodiment, the aspect in which the surface of the developing roller 231 is subject to the knurled grooving has been described, but the surface of the developing roller 231 may have a dimple shape or may be subject to blast working.

(2) In the above embodiment, the aspect in which the mode control unit 984 can execute both the charging amount measuring mode and the charging amount distribution measuring mode has been described, but the mode control unit 984 may execute any one of the measuring modes.

(3) As illustrated in FIG. 1, in the case where the image forming apparatus 10 includes the plurality of developing devices 23, one or two developing devices 23 execute both or one of the charging amount measuring mode and the charging amount distribution measuring mode according to the embodiment, and another developing device 23 may use the results in the modes.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

an image carrier that is rotated and carries a toner image obtained by developing an electrostatic latent image which is formed on a surface of the image carrier;

a charging device that charges the image carrier to a predetermined charging potential;

an exposing device that exposes the surface of the image carrier charged to the charging potential, based on predetermined image information so as to form the electrostatic latent image, the exposing device being disposed in a rotational direction of the image carrier downstream with respect to the charging device;

a developing device that includes a developing roller that is rotated, carries developer including toner and carrier on a peripheral surface of the developing roller, and supplies the toner to the image carrier so as to form the toner image, the developing device being disposed in a predetermined development nip portion in the rotational direction downstream with respect to the exposing device so as to oppose the image carrier;

a toner density detecting unit that detects toner density of the developer in the developing device;

a transfer unit that transfers the toner image carried on the image carrier to a sheet;

a development bias applying unit that applies a development bias obtained by superimposing an alternating current voltage on a direct current voltage to the developing roller;

a density detecting unit that detects density of the toner image;

a storage unit that stores reference information in advance for each toner charging amount and each toner density, the reference information relating to a tilt of a reference straight line representing a relationship between a change amount of a frequency of the alternating current voltage of the development bias and a density change amount of the toner image in a case where the frequency is changed with a potential difference in the direct current voltage between the developing roller and the image carrier being kept constant; and a charging amount acquisition unit that performs a charging amount acquisition operation for forming a measurement toner image on the image carrier while changing the frequency of the alternating current voltage of the development bias with the potential difference in the direct current voltage between the developing roller and the image carrier being kept constant, acquiring a tilt of a measurement straight line representing a relationship between the change amount of the frequency and a density change amount of the measurement toner image based on the change amount of the frequency and a result of detecting density of the measurement toner image in the density detecting unit, and acquiring a charging amount of the toner included in the measurement toner image formed on the image carrier based on the acquired tilt of the measurement straight line and the reference information in the storage unit according to the toner density detected by the toner density detecting unit, wherein the reference information, which relates to predetermined toner density and is stored in the storage unit, is set such that when the toner charging amount is a first charging amount, the tilt of the reference straight line is negative, when the toner charging amount is a second charging amount smaller than the first charging amount, the tilt of the reference straight line is positive, and as the toner charging amount becomes smaller, the tilt of the reference straight line becomes greater.

2. The image forming apparatus according to claim 1, wherein the reference information is information fixed regardless of the toner density when the toner density detected by the toner density detecting unit is included in a first region that is equal to or more than a predetermined threshold defined by the reference straight line, and is set such that when the toner density is included in a second region that is less than the predetermined threshold defined by the reference straight line, the toner charging amount with respect to a predetermined tilt of the reference straight line is higher than a toner charging amount in the first region.

3. An image forming apparatus comprising:

an image carrier that is rotated and carries a toner image obtained by developing an electrostatic latent image which is formed on a surface of the image carrier;

a charging device that charges the image carrier to a predetermined charging potential;

an exposing device that exposes the surface of the image carrier charged to the charging potential, based on predetermined image information so as to form the electrostatic latent image, the exposing device being disposed in a rotational direction of the image carrier downstream with respect to the charging device;

a developing device that includes a developing roller that is rotated, carries developer including toner and carrier on a peripheral surface of the developing roller, and supplies the toner to the image carrier so as to form the toner image, the developing device being disposed in a predetermined development nip portion in the rotational direction downstream with respect to the exposing device so as to oppose the image carrier;

a toner density detecting unit that detects toner density of the developer in the developing device;

a transfer unit that transfers the toner image carried on the image carrier to a sheet;

a development bias applying unit that applies a development bias obtained by superimposing an alternating current voltage on a direct current voltage to the developing roller;

a density detecting unit that detects density of the toner image;

a storage unit that stores reference information in advance for each toner charging amount and each toner density, the reference information relating to a tilt of a reference straight line representing a relationship between a change amount of a frequency of the alternating current voltage of the development bias and a density change amount of the toner image in a case where the frequency is changed with a potential difference in the direct current voltage between the developing roller and the image carrier being kept constant; and a charging amount acquisition unit that performs a charging amount acquisition operation for forming a measurement toner image on the image carrier while changing the frequency of the alternating current voltage of the development bias with the potential difference in the direct current voltage between the developing roller and the image carrier being kept constant, acquiring a tilt of a measurement straight line representing a relationship between the change amount of the frequency and a density change amount of the measurement toner image based on the change amount of the frequency and a result of detecting density of the measurement toner image in the density detecting unit, and acquiring a charging amount of the toner included in the measurement toner image formed on the image carrier based on the acquired tilt of the measurement straight line and the reference information in the storage unit according to the toner density detected by the toner density detecting unit, wherein the charging amount acquisition unit performs a first charging amount acquisition operation at a first peak-to-peak voltage of the alternating current voltage of the development bias, performs a second charging amount acquisition operation at a second peak-to-peak voltage, which is higher than the first peak-to-peak voltage, of the alternating current voltage of the development bias, and performs a charging amount distribution acquisition operation for acquiring distribution of the toner charging amount based on results in the first charging amount acquisition operation and the second charging amount acquisition operation.

4. The image forming apparatus according to claim 3, wherein the reference information is information fixed regardless of the toner density when the toner density detected by the toner density detecting unit is included in a first region that is equal to or more than a predetermined threshold defined by the reference straight line, and is set such that when the toner density is included in a second region that is less than the predetermined threshold defined by the reference straight line, the toner charging amount with respect to a predetermined tilt of the reference straight line is higher than a toner charging amount in the first region.

* * * * *